US005619009A

United States Patent [19]

Le Grouyellec

[11] Patent Number: 5,619,009

[45] Date of Patent: Apr. 8, 1997

[54] SMOKE BOMB CASE

[75] Inventor: Andre Le Grouyellec, Grandchamp, France

[73] Assignee: Princhim S.A., France

[21] Appl. No.: 594,130

[22] Filed: Jan. 31, 1996

[30] Foreign Application Priority Data

Jan. 31, 1995 [FR] France ..... 95 01310

[51] Int. Cl.[6] ..... F42B 12/48

[52] U.S. Cl. ..... 102/334; 102/350; 102/367

[58] Field of Search ..... 102/334, 350, 102/367

[56] References Cited

U.S. PATENT DOCUMENTS

| | | | |
|---|---|---|---|
| 3,599,571 | 8/1971 | Richardson | 102/65 |
| 3,713,383 | 1/1973 | Crescenzo | 102/6 |
| 4,171,669 | 10/1979 | Allen | 102/37.6 |
| 4,727,811 | 3/1988 | Lubbers | 102/334 |
| 4,898,098 | 2/1990 | Frey et al. | 102/334 |
| 5,094,168 | 3/1992 | Rumer | 102/334 |
| 5,522,320 | 6/1996 | Dillehay | 102/334 |

FOREIGN PATENT DOCUMENTS

| | | |
|---|---|---|
| 776684 | 11/1934 | France . |
| 659189 | 3/1938 | Germany . |
| 1153296 | 8/1963 | Germany . |
| 276198 | 8/1927 | United Kingdom . |
| 614634 | 12/1948 | United Kingdom . |
| 1140063 | 1/1969 | United Kingdom . |

*Primary Examiner*—Peter A. Nelson
*Attorney, Agent, or Firm*—Laff, Whitesel, Conte & Saret, Ltd.

[57] ABSTRACT

Improvements applied to the case of a smoke bomb.

This invention relates to the envelope of a smoke bomb case.

It consists, on the one hand, of a traditional wall (1), resistant to the pressure of the smoke bomb constituents (4) when it is the object of the exothermic reaction of the smoke bomb powder, once it has been initiated by an adequate technique. It comprises, on the other hand, at least one area of reduced resistance (3), formed by a relatively fine layer, the said area being covered by a cover (2) of a resistance comparable to the remainder of the traditional wall (1), and which is pierced by a large number of holes (6, 7, and 8).

It is characterized by the fact that each hole (6 or 7 or 8) of said cover (2) has a warped form.

3 Claims, 1 Drawing Sheet

SMOKE BOMB CASE

Figure 1:
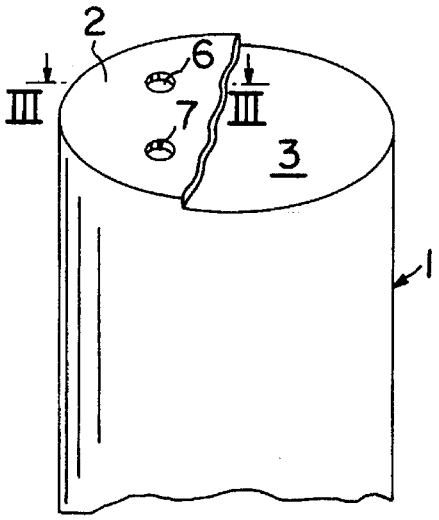

This invention relates to an improvement applied to a smoke bomb case.

Smoke bomb cases are subjected, depending on the smoke powders which they contain, to internal pressures when the reaction is initiated, which may vary depending on the nature of the powders and the function of the ambient temperature and the humidity of the powders. A satisfactory function of the cases and good efficiency are achieved when the internal pressure of the gas engendered by the powders is relatively constant, and provided that it does not exceed the bursting resistance limit of the case.

In general terms, in equipment intended to induce tears, provision is made for envelopes which contain areas which have been deliberately weakened, as described in FR-A-2 683 626, or perforations, as in FR-A-2 053 943, to guide the tear-inducing gas out of the equipment or the grenade. These weakened areas or perforations do not guarantee that the pressure of the gas leaving the envelope is constant, but simply that these gases will emerge. Little account is taken of the fact that excessive pressure might cause the envelope of the tear-gas device to explode, bearing in mind that the gases escaping are incapacitating agents. These types of equipment are generally used in the open air, in streets or public squares, or on the battlefield, for example, where the wind is responsible for dispersing the tear gas and the smoke.

The cases of smoke bombs are used with anti-theft security systems, particularly in order to protect the merchandise and equipment stocked in depots and other locations. In this case, in order for the smoke bombs to be effective, when the combustion of the powder is initiated and thereafter, it is essential for the pressure of the gas to be as constant as possible, while ensuring the satisfactory dispersion of the gas and avoiding, under all circumstances, the bursting of the case, which would have several disadvantages. Bursting would not only incur too rapid a liberation of the gases, but would also project particles of the smoke powders around the case, which would not have completed the combustion of their constituents, and which would therefore be at least partially burning at high temperatures, or constituents which had not yet started to react and which would disperse in the form of dust. The dispersion of burning particles is hazardous to the merchandise which the smoke bomb is intended to protect, the dispersion of the dust likewise presents evident disadvantages by contaminating the merchandise or equipment.

An attempt may be made to avoid the bursting of the case by selecting powders of such a nature that the chemical reaction of the constituents is slow, but in this case the unit loses part of its effectiveness, since the smoke gases come out so slowly that the blinding effect on the intruders is not ensured or is only poor.

Apart from this, the environmental conditions, temperature and humidity, cause the speed of exothermic reactions to vary, and the nature of the powder cannot therefore be relied upon to avoid bursting and attaining the ideal level of effectiveness.

It is known to insert a plastic or metallic film beneath the pierced cover of a smoke bomb case and in contact with said cover, in such a manner as to obtain the liberation of the gases engendered by the powder under a determined pressure, as described in DE-B-1 153 296. When the internal pressure of said gases attains a given value, it tears the parts of the film located beneath the perforations of the cover, which usually present a right cylinder geometry.

A major drawback of such a type of smoke bomb case is that it imperfectly cuts the part of the film located beneath each perforation, some film shreds remaining clung to the circumference of the perforation. As a result, droplets engendered by condensation of residues of unburnt and sublimated powder are projected outside the cover. This induces fat smokes and a lesser liberation of the smoke gas in comparison to what it would be without said droplets.

One object of the invention consists of providing for an envelope for a smoke bomb case which avoids all risk of bursting when the reaction of the smoke-generating powder is initiated, and which ensures the rapid discharge of the smoke gases under a relatively substantial and constant pressure.

Another object of the invention is to provide for a smoke bomb case which is of such a structure that no projection of condensates or dusts takes place, said condensates and dusts lowering the efficiency of the case.

According to one characteristic of the invention, the envelope of a smoke bomb case consists, on the one hand, of a traditional wall which is resistant to the pressure of the powder when it is the object of the exothermal reaction after having been initiated by an adequate technique, and, on the other hand, of at least one area of lesser resistance, formed by a relatively fine bed, the said area being covered by a resistance layer comparable to the rest of the wall, and which is pierced by a considerable number of holes. Said envelope is characterised by the fact that each hole of said cover has a warped form.

According to another characteristic, each hole has its lower edge jagged in such a manner as to form cutting unevennesses.

According to another characteristic, the area of reduced resistance consists of an aluminium film.

Figure 2:
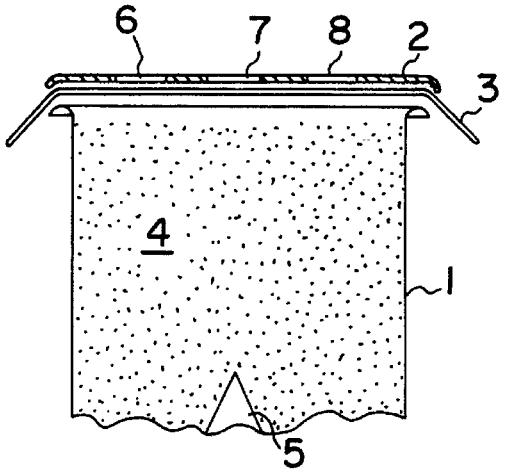
Figure 3:
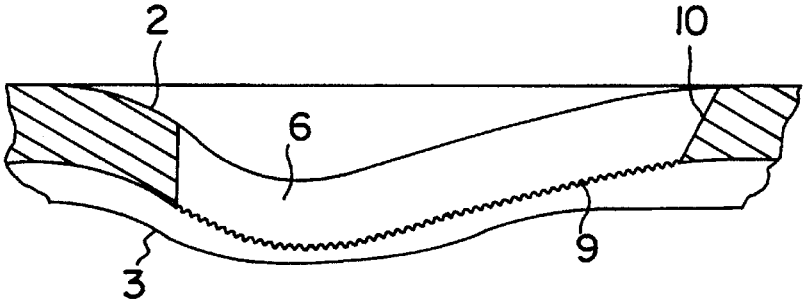

The characteristics of the invention referred to above, as well as others, become more apparent by reading the following description of an embodiment of the device, the description being related to the appended drawings, in which:

FIG. 1 is a partial perspective view of a smoke bomb case according to the invention, and FIG. 2 is a sectional view, on a larger scale, of the pierced cover and the area of reduced resistance of the smoke bomb case of FIG. 1, illustrating the manner of crimping onto the body of the case, and FIG. 3 is a partial sectional view on the line III—III of FIG. 1 of the pierced cover and of the area of reduced resistance of the smoke bomb case.

The smoke bomb case in FIG. 1 has the shape of a cylindrical can of preserves, and consists of a cylindrical body 1 and a cover 2, with, beneath the cover 2, a cap 3. The cap 3 and the top of the body 1 are welded in such a way as to form a sealed envelope containing the smoke powder or tablets 4, and the fuse 5, represented symbolically. The cover 2 is crimped onto the upper side of the cylindrical body 1, as on a can of preserves. Once crimping has been applied, the cap 3 is in contact over the whole of its surface with the internal face of the cover 2.

In another embodiment example, illustrated in FIG. 2, the cap 3 and the cover 2 are crimped onto the upper edge of the body 1, in the course of the same crimping operation.

The cover 2 is pierced with holes, such as 6,7, and 8, which are practically circular and which have a diameter of the order of 0.5 cm, for example. Depending on the powders used, and the size of the case of the smoke bomb, the value of the diameter may vary.

The cap 3 can, for example, be provided in the form of a film with a clearly defined tearing resistance. For preference, the cap 3 is made up of a thin aluminium film. The thickness of said film is preferably of 2 or 3 microns, for example.

As can be seen in FIG. 3, which is relative to the embodiment illustrated in FIG. 2 where the cap 3 and the cover 2 are crimped upon the upper edge of the body 1, each hole 6 or 7 or 8 is warped and has its sharp edge 9 turned to the inside of the case, said sharp edge 9 being jagged in such a manner that it has a large number of cutting points.

Firstly, there is carried out a punching onto the cover 2 by means of a punch whose dimensions are substantially lower to those of the punching die placed beneath the cover 2. There is thus obtained a hole 6 or 7 or 8 whose lower edge 10 is jagged and also has cutting unevennesses. There is further performed a warping of this hole 6 or 7 or 8 by means of a rod, which is axially inserted into said hole 6 or 7 or 8 and swung as far as the wall 10 of the hole 6 or 7 or 8 in order to deform it then. The edge 10 of said hole 6 or 7 or 8 has thus such an inclination as to efficiently cut the part of the film 3 located just beneath, during the chemical reaction taking place inside the smoke bomb case.

The operation of a smoke bomb case, according to the invention, is as follows: At the outset, the pressure of the gas, building up inside the body of the smoke bomb, activates the combustion of the powders or the tablets which engender the smoke. When the internal pressure rises, the cap 3 is pressed hard against the holes or apertures 6, 7 and 8. This results in an initial perforation of the cap opposite one of the holes 6, 7 or 8, thus allowing the smoke gases to escape. When the pressure rises still further, other perforation occur in succession opposite the holes 6, 7, and 8 in the cover, which avoids the risk of bursting.

Because of the form of each hole 6 or 7 or 8, the smoke gases under pressure can clearly cut a circular pellet of the film 3 beneath said hole 6 or 7 or 8. There is thus avoided the formation of film shreds which remain clung to the edge 10 of each hole 6 or 7 or 8, and as a consequence the projection of droplets or condensates of unburnt resinous smokes, which lower the efficiency of the smoke bomb case.

Since the resistance of the cap 3 to tearing is constant, the pressure of the gas issuing from the case is constant.

Clearly, the number of holes 6, 7, and 8 or apertures in the cover is determined on the basis of experimentation on smoke bomb cases.

I claim:

1. An envelope of a smoke bomb case, consisting, on the one hand, of a traditional wall (1), resistant to the pressure of the smoke bomb constituents (4) when it is the object of the exothermic reaction of the smoke bomb powder, once it has been initiated by an adequate technique, and on the other hand, at least one area of reduced resistance (3), formed by a relatively fine layer, the said area being covered by a cover (2) of a resistance comparable to the remainder of the wall (1), and which is pierced by a large number of holes (6, 7, and 8), characterised by the fact that each hole (6 or 7 or 8) of said cover (2) has a warped form.

2. An envelope of a smoke bomb case according to claim 1, characterised by the fact that each hole (6 or 7 or 8) has its lower edge (9) jagged in such a manner as to form cutting unevennesses.

3. An envelope of a smoke bomb case according to claims 1 or 2, characterised by the fact that the area of reduced resistance (3) consists of an aluminium film.

* * * * *